US006759965B1

(12) United States Patent
Hatjasalo et al.

(10) Patent No.: US 6,759,965 B1
(45) Date of Patent: Jul. 6, 2004

(54) LIGHT INDICATOR

(75) Inventors: Leo Hatjasalo, Helsinki (FI); Kari Rinko, Helsinki (FI)

(73) Assignee: Oy ICS Intelligent Control Systems LTD, Helsinki (FI)

( * ) Notice: Subject to any disclaimer, the term of this patent is extended or adjusted under 35 U.S.C. 154(b) by 0 days.

(21) Appl. No.: 09/979,737

(22) PCT Filed: May 19, 2000

(86) PCT No.: PCT/FI00/00450

§ 371 (c)(1),
(2), (4) Date: Nov. 28, 2001

(87) PCT Pub. No.: WO00/74025

PCT Pub. Date: Dec. 7, 2000

(30) Foreign Application Priority Data

May 28, 1999 (FI) ..... 991217

(51) Int. Cl.[7] ..... G08B 5/00

(52) U.S. Cl. ..... 340/815.4; 340/815.42; 340/815.45; 340/461; 362/31; 362/32; 362/227; 362/234; 359/13; 359/14; 359/15; 116/216; 116/219

(58) Field of Search ..... 340/815.4, 815.42, 340/815.45, 461; 362/31, 32, 227, 234; 359/13, 14, 15; 116/216, 219

(56) References Cited

U.S. PATENT DOCUMENTS

| | | | | |
|---|---|---|---|---|
| 5,105,568 A | | 4/1992 | Branning | 40/570 |
| 5,122,890 A | * | 6/1992 | Makow | 349/96 |
| 5,299,109 A | | 3/1994 | Grondal | 362/241 |
| 5,319,491 A | * | 6/1994 | Selbrede | 359/291 |
| 5,428,912 A | | 7/1995 | Grondal et al. | 40/570 |
| 5,481,440 A | * | 1/1996 | Oldham et al. | 362/555 |
| 5,499,597 A | * | 3/1996 | Kronberg | 116/216 |
| 5,506,929 A | | 4/1996 | Tai et al. | 385/146 |
| 5,542,201 A | | 8/1996 | Grondal et al. | 40/570 |
| 5,594,560 A | * | 1/1997 | Jelley et al. | 359/15 |
| 5,703,667 A | | 12/1997 | Ochiai | 349/65 |
| 5,742,433 A | | 4/1998 | Shioino et al. | 359/575 |
| 5,748,106 A | * | 5/1998 | Schoenian et al. | 340/928 |
| 5,761,540 A | * | 6/1998 | White | 396/4 |
| 5,851,615 A | * | 12/1998 | Kay | 428/40.1 |
| 5,892,599 A | * | 4/1999 | Bahuguna | 359/15 |
| 5,903,243 A | * | 5/1999 | Jones | 345/7 |
| 5,991,078 A | * | 11/1999 | Yoshitake et al. | 359/567 |

(List continued on next page.)

FOREIGN PATENT DOCUMENTS

| | | |
|---|---|---|
| EP | 1016817 | 7/2000 |
| FI | 1533 | 6/1994 |
| FI | 98768 | 4/1997 |
| FI | 992732 | 6/2000 |
| FI | 982825 | 1/2001 |
| WO | 03/004931 | 1/2003 |

*Primary Examiner*—Daniel J. Wu
*Assistant Examiner*—Tai T. Nguyen
(74) *Attorney, Agent, or Firm*—Venable LLP; Eric J. Franklin, Esq.

(57) ABSTRACT

The invention relates to a light indicator, comprising an indicator element (2) illuminable by a light source (1). The indicator element is manufactured from a substantially transparent material provided with an informative indicator pattern. The indicator element (2) is designed as a waveguide panel, wherein light beams propagate with total reflection and get outcoupled therefrom with a diffractive outcoupling system (2*u*), such as a grating structure or the like, which is configured as an indcator pattern, for producing an indicator pattern (2*a*) activable in the indicator element (2) by the action of light, such that divergent recesses and/or grooves of various sizes and/or shape constitute divergent local gratings of various sizes and/or shapes, such as multi-shaped and/or binary pixels and/or units, the filling factor, shape, profile and/or size thereof being optimized in such a way that the difraction efficiency is a function of place.

30 Claims, 10 Drawing Sheets

U.S. PATENT DOCUMENTS 6,011,602 A 1/2000 Miyashita et al. ..... 349/65
6,011,650 A * 1/2000 Parker et al. ..... 359/567
6,036,328 A 3/2000 Ohtsuki et al. ..... 362/31
6,144,480 A 11/2000 Li et al. ..... 359/279
6,147,732 A * 11/2000 Aoyama et al. ..... 349/112
6,151,166 A * 11/2000 Matsushita et al. ..... 359/566
6,196,691 B1 * 3/2001 Ochiai ..... 362/31
6,199,995 B1 3/2001 Umemoto et al. ..... 362/31
6,247,826 B1 6/2001 Funamoto et al. ..... 362/31
6,260,989 B1 * 7/2001 Ingraselino ..... 362/383
6,356,389 B1 * 3/2002 Nilsen et al. ..... 359/625
6,377,370 B1 * 4/2002 Taketomi et al. ..... 359/15
6,396,409 B1 * 5/2002 Yeh ..... 340/815.42
6,421,109 B1 * 7/2002 Popovich ..... 349/202
6,545,778 B2 * 4/2003 Ono et al. ..... 359/13

* cited by examiner

LIGHT INDICATOR

CROSS-REFERENCES TO RELATED APPLICATION

This application is a 371 of a PCT/F100/00450 filed on May 19, 2000 which claims for foreign priority benefit of Finland application 991217 filed on May 28,1999.

FIELD OF THE INVENTION

The invention relates to a light indicator, comprising an indicator element illuminable by means of a light source. The indicator element is manufactured from a substantially transparent material which is provided with an informative indicator pattern.

BACKGROUND OF THE INVENTION

It is prior known to outfit e.g. illuminators and indicator panels in exit ways with conventional incandescent lamps or fluorescent tubes. One such example can be found e.g. in Finnish utility model No. 1533. The cited solution comprises a light panel fitted with an illuminator cover, wherein the light of a fluorescent illuminator tube fitted inside the illuminator cover is directed out by way of the perimeter of a panel element mounted in connection with a light source. In this particular solution, the illuminator cover is provided with an elongated, cover-length opening for replacing the fluorescent illuminator tube therethrough from above. However, a drawback with this type of traditional indicator panels is the short service life of incandescent lamps and fluorescent tubes as the exit lights must be switched on all the time.

The Finnish patent No. 98768 discloses an indicator panel, showing permanently the way especially to the exit routes of a building and comprising a plate-like body, light emitting diodes mounted on the body in its back surface and extending therethrough, and light emitting diodes extending through the bottom edge of a frame-like cover set on top of the body. In this cited solution, the light emitting diodes extending through the body are adapted to illustrate the body of an indicator panel, especially over its front surface which is provided with a pattern of an after-luminous material. In addition, the light emitting diodes extending through the bottom edge of the cover are configured as a downward-directed, white-light emitting light source, comprising green and red light emitting diodes, which are arranged successively at the bottom edge of the cover and which illuminate an exit route present below the indicator panel or a direction arrow therefor.

The latter solution is beneficial in the sense that the light source comprises low-power leds, which are capable of providing a sufficiently reliable guidance action at comparatively attractive total costs despite being permanently switched on. However, a pattern of an after-luminous material present on the front surface of an indicator panel, as applied in the cited solution, as well as a string of leds illuminating the same, represent currently outdated technology, which is why, at present, this particular type of illumination objective should be carried out by using solely a downward-directed bank of leds. In the cited solution, however, the lighting action has been exploited unfavourably even in this respect, since the leds delivering light downwards have been mounted on the bottom edge of a cover, from which said leds direct light in a traditional fashion therebelow directly into an air space surrounding the illuminator cover. In this conjunction, however, the light produced by the leds easily dissipates in the ambience, e.g. as a result of the leds being soiled or e.g. in smoky conditions, and hence the cited solution is not capable of making it sufficiently certain that a direction arrow or the like present below this type of indicator panel would indeed be illuminated in an emergency.

SUMMARY OF THE INVENTION

It is an object of a light indicator of this invention to provide a decisive improvement over the above problems and, thus, to substantially raise the available state of the art. In order to accomplish this object, a light indicator of the invention is principally characterized in that the indicator element is designed as a waveguide panel, wherein light beams propagate with total reflection and get outcoupled therefrom with a diffractive outcoupling system, such as a grating structure or the like, which is configured as an indicator pattern, for producing an indicator pattern activable in the indicator element by the action of light, such that divergent recesses and/or grooves of various sizes and/or shapes constitute divergent local gratings of various sizes and/or shapes, such as multi-shaped and/or binary pixels and/or units, the filling factor, shape, profile and/or size thereof being optimized in such a way that the diffraction efficiency is a function of place.

Diffractive structures refer in optics to all fine structures of a surface, which condition the passage of light on the basis of the diffraction effect. Thus, the details of fine structures must be in the same order of magnitude as the wavelength of light, even smaller than that. Most prior known microprismatic structures are not even diffractive structures as conditioning the passage of a beam therein is based on the refraction effect. On the other hand, the hologram is not a grating, whereas the grating does not produce a three-dimensional image or light. The local grating, in turn, refers to a local grating unit, such as e.g. a pixel. Furthermore, the entire grating structure may be constituted by a great variety of miscellaneous grating units.

The most important benefits gained by a light indicator of the invention include its simplicity, efficiency, and reliability in operation, since, in this conjunction, it is first of all possible to make use of very low-power leds as a light source. On the other hand, by virtue of a total-reflection based waveguide panel construction utilized in the invention, the light source can be optimized in all aspects since it is possible to minimize unintentional reflection losses and other light losses. On the other hand, the invention also makes it possible for a light indicator to function in a so-called active fashion, i.e. in such a way that, first of all, when the light source is disconnected from the entire indicator element or, for example, from a given section of the indicator pattern, this section is by no means visible, since, according to the basic concept of the invention, a desired indicator pattern is only activated to be visible as a result of light guided therein. Thus, it is possible to use one and the same indicator element for arrows pointing in different directions in such a way that the direction arrow needed at a given time is activated as required by the situation, the arrow pointing in the opposite direction being invisible.

By virtue of a principle exploited in the invention, it is further possible to make extremely thin structures, which can be embedded in a substrate, or else to manufacture flexible or preformed structures by providing every time such conditions that the limit or threshold angle of total reflection is not exceeded in the panel element. The invention makes it further possible to design the panel element for example as a box-type structure, such as a quadratic or tubular "lamp post", inside which the light reflects with total reflection and emerges only at the outcoupling system so as to activate nothing else but a given desired indicator pattern or the like. Furthermore, another possible application for a light indicator of the invention is that one and the same indicator pattern carries for example portions activable at various wavelengths for providing various indicator images, said application being of course implementable also by modifying the intensity/operating voltage of a light source, etc.

BRIEF DESCRIPTION OF THE DRAWINGS

The invention will be described in more detail in the following specification with reference made to the accompanying drawings, in which.

DETAILED DESCRIPTION OF THE INVENTION

The invention relates to a light indicator, comprising an indicator element 2 illuminable by means of a light source 1. The indicator element is manufactured from a substantially transparent material which is provided with an informative indicator pattern. The indicator element 2 is configured as a waveguide panel, wherein light beams propagate with total reflection and get outcoupled therefrom by means of an outcoupling system 2*u*, such as a grating structure or the like, which is adapted to comply with the shape of an indicator pattern, for producing an indicator pattern 2*a* activable in the indicator element 2 by the action of light, such that divergent recesses and/or grooves of various sizes and/or shapes constitute divergent local gratings of various sizes and/or shapes (e.g. type A/B), such as multi-shaped and/or binary pixels and/or Naturally, it is possible to adapt the size, shape, filling factor and/or the profile/structure of a local grating or a grid unit in various sections of a grating structure to be variable in terms of lengthwise, lateral and/or vertical directions.

Figure 1A:
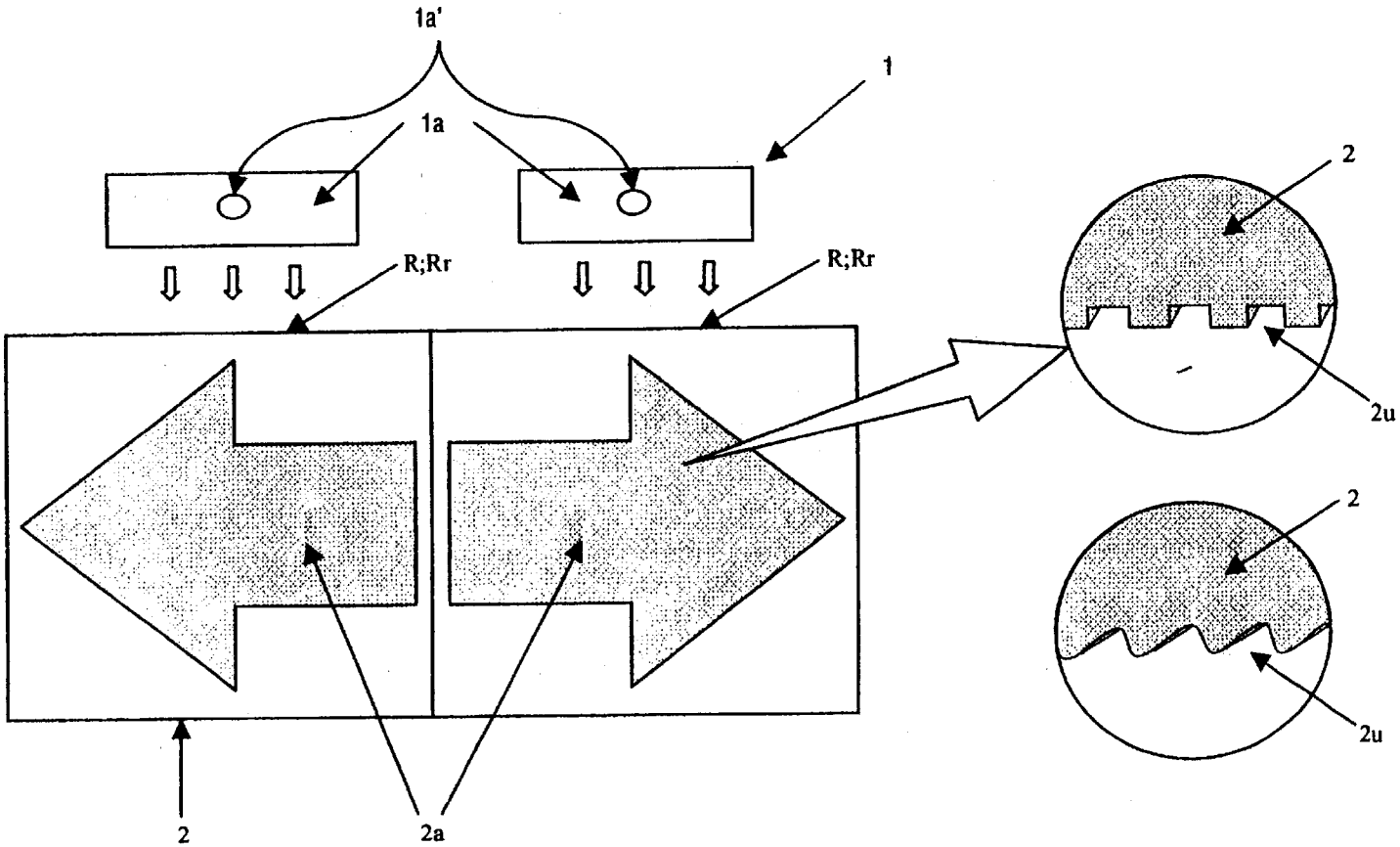
FIGS. 1*a* and 1*b* show an operating principle for one preferred light indicator of the invention.
Figure 1B:
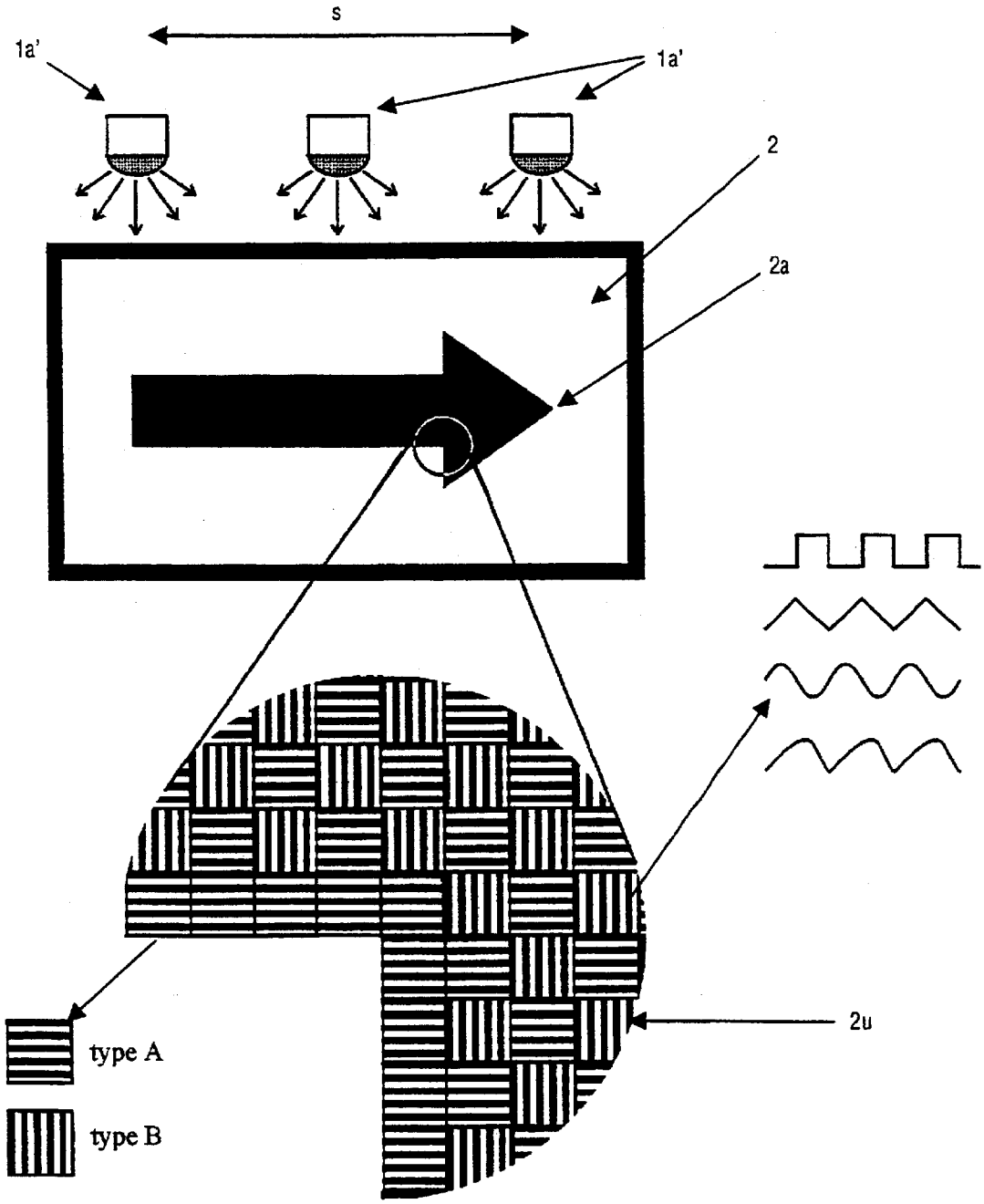

Furthermore, in reference to what is shown in FIGS. 1*a* and 1*b*, the light source 1 is provided with one (FIG. 1*a*) or more (FIG. 1*b*) leds 1*a*' successive in lengthwise direction s for illuminating the indicator pattern of an indicator element with light delivered into the indicator element. The light incoupling into the indicator element 2 is arranged, as shown e.g. in FIG. 6*b*, by means of a diffractive incoupling system 2*s* present at a boundary surface R; Rr in the indicator element 2, such as a binary beam distributor, a local grating structure, a diffuser and/or the like, and/or, as shown e.g. in FIG. 6*a*, by means of geometric contours of the boundary surface R.

Figure 1C:
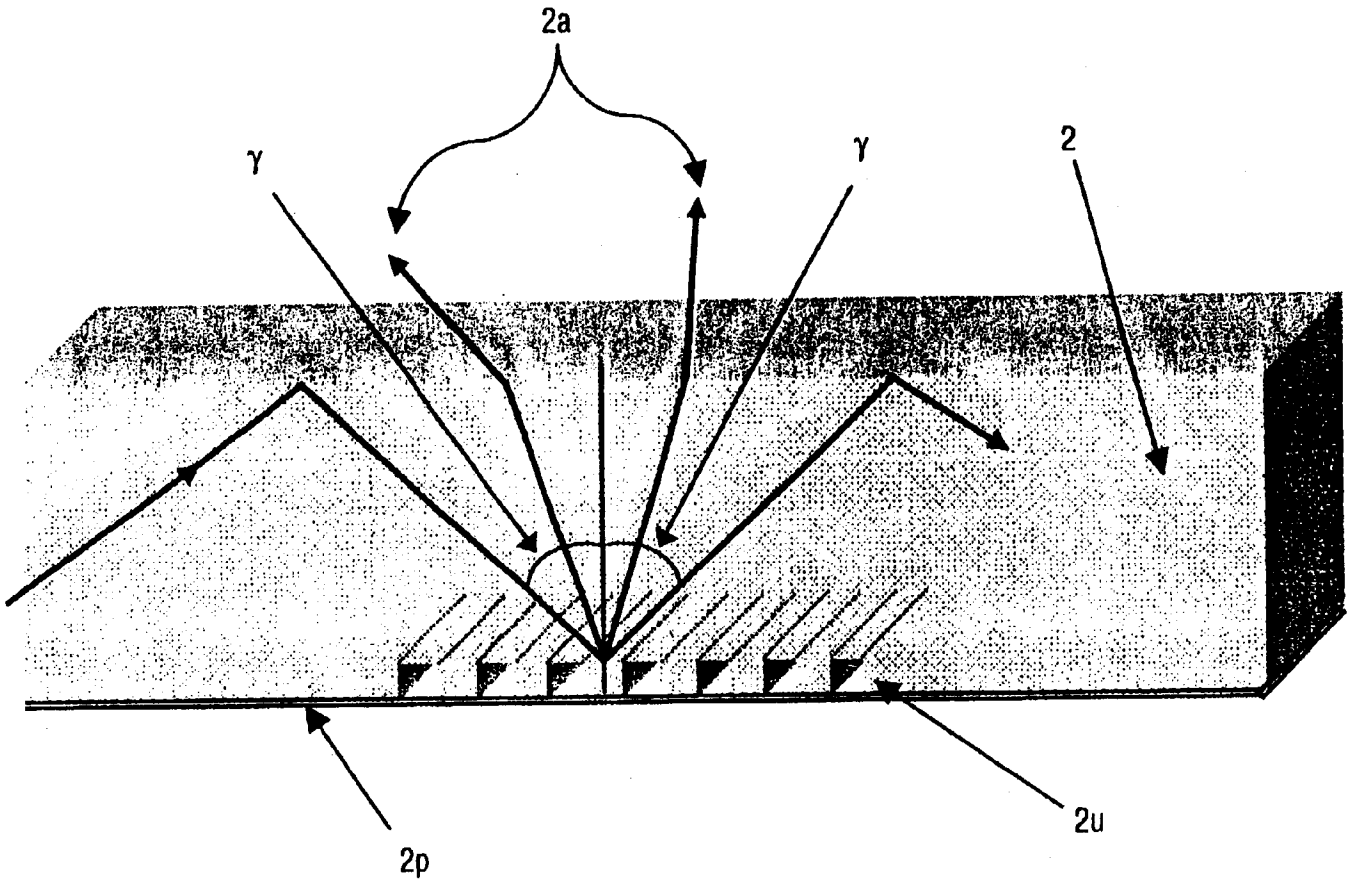
FIG. 1*c* illustrates further how to activate in principle the indicator pattern of a light indicator of the invention.

In the embodiment shown in FIG. 1*c*, a diffractive outcoupling system 2*u*, such as a local grating structure or the like, for an indicator element 2 functioning as a waveguide panel is arranged on a bottom surface 2*p* of the indicator element 2. Of course, it is also possible to arrange such a system on the indicator element's top surface, which nevertheless requires in practice some sort of protective layer or coating for its mechanical protection.

Figure 6B:
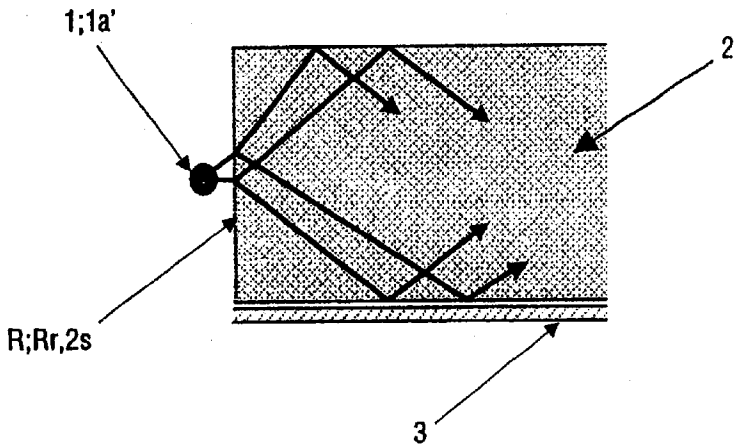
Figure 6A:
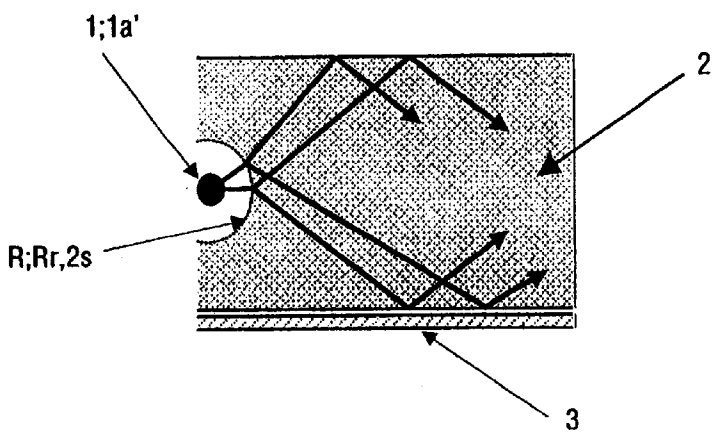

In a further preferred embodiment, the indicator element 2 is manufactured from a thin and optically transparent manufacturing material, having a thickness of e.g. 0.1–4 mm, such a polymeric, elastomeric, ceramic material panel, sheet or the like, the incoupling system 2*s* being still preferably arranged at its perimeter Rr, as shown e.g. in FIGS. 6*a* and 6*b*.

In a further preferred embodiment, the light indicator 2 is manufactured from a flexible or preformed manufacturing material, the indicator element 2 having its indicator pattern 2*a* adapted to activate by maintaining the local radius of curvature of the indicator element 2 sufficiently small everywhere, such that the threshold angle of total reflection shall not be exceeded as the light beam travels within the indicator element 2.

In a further preferred embodiment, the diffractive outcoupling system 2*u* constituting an active indicator pattern 2*a* is set up in such a way that the indicator pattern 2 can be worked into (diffractive) patterns of various colours. First of all, this is possible to implement in such a way that one or more indicator images of the indicator pattern 2*a* activable to a different colour activates by providing one or more independently controllable lighting units 1; 1*a* with light means producing a different colour light, such a red/green/blue/white led (1*a*') or the like. On the other hand, it is also possible to achieve this by changing the intensity, supply voltage and/or the like of a light source or its integral elements.

In further reference to the embodiment shown e.g. in FIG. 1*b*, the indicator element 2 is provided with a responsive surface 3, such as a reflector, a diffuser and/or the like, particularly for eliminating beams transmitted from a grating structure or the like of the outcoupling system 2*u* and/or for preventing the formation of pronounced light spots.

Figure 7:
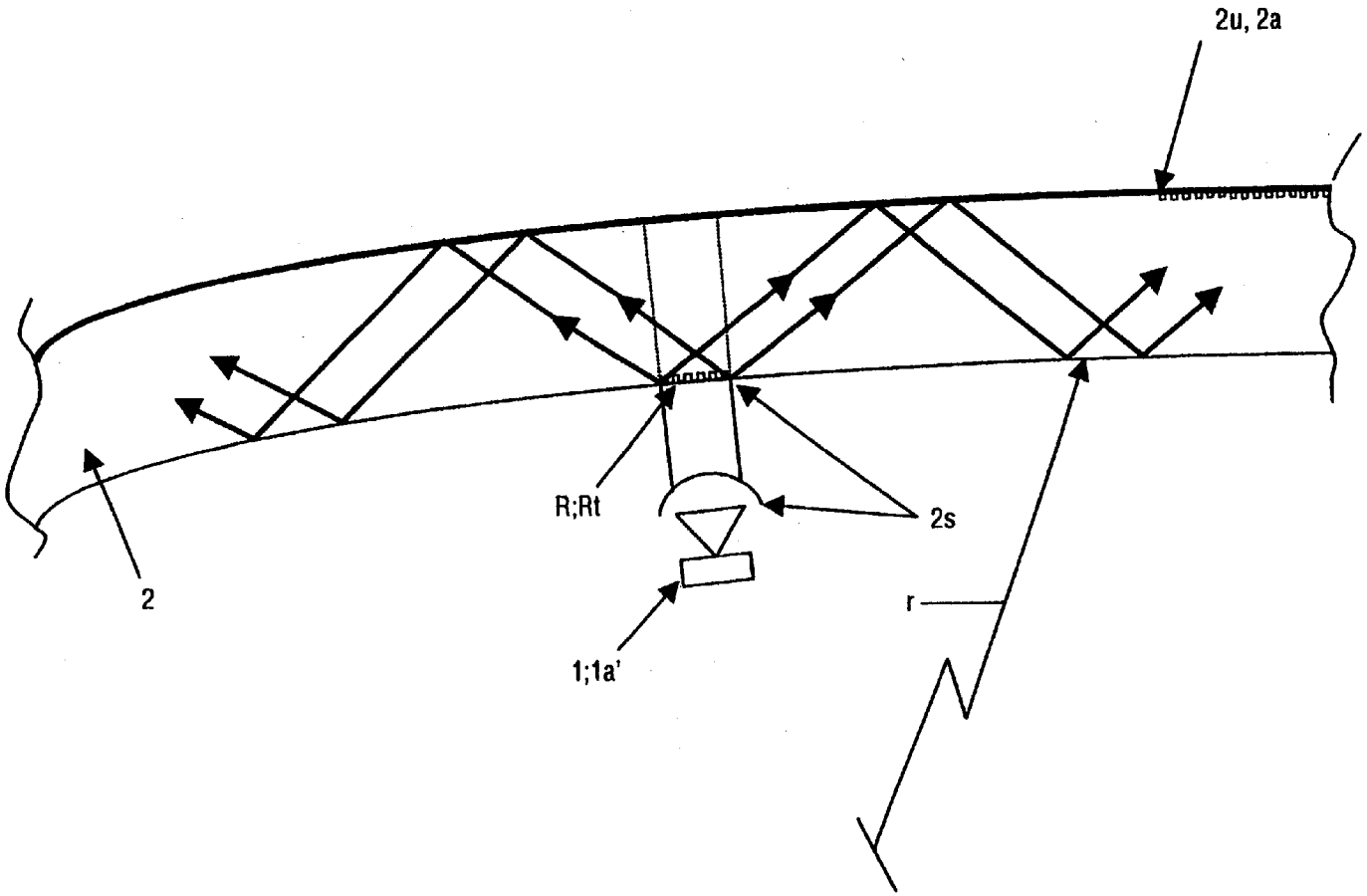
FIG. 7 shows a light indicator of the invention in a columnar waveguide embodiment.

In a further preferred embodiment as shown e.g. in FIG. 7, the light indicator is configured as a closed box-type structure, such as a light indicator column, which is provided with an incoupling system 2*s* by using a beam distributor or the like present at a front or back surface Rt of the indicator element 2 for focusing the light emitted from the light source 1 to propagate with total reflection within the indicator element 2.

Figure 2A:
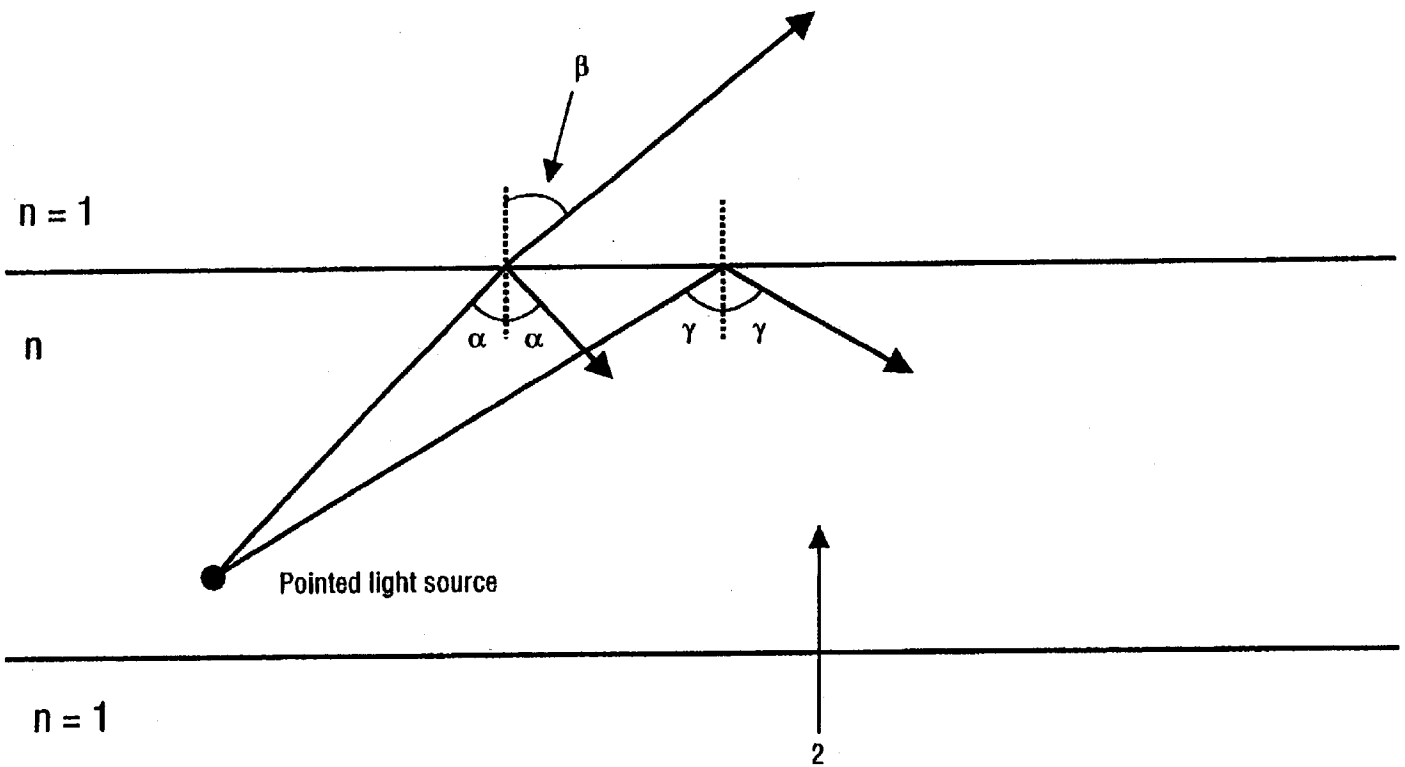
FIGS. 2*a*, 2*b*, and 3 illustrate certain principles in relation to total reflection.

Generally speaking, it should be noted about the theory concerning total reflection, in reference to FIG. 2*a* depicting a waveguide panel 2, having a refractive index n which exceeds the refractive index of air n=1, that the beam emerging from a spot source will be subjected to total reflection, provided that its angle of incidence to a boundary surface, $\gamma$, fulfils the condition $\sin \gamma > 1/n$. If the angle of incidence is smaller than this, e.g. $\alpha < \arcsin(1/n)$, the portion of energy expressed by Fresnel patterns shall penetrate a boundary surface. If the medium is other than air, the refractive index 1 in the preceding expressions is replaced with the refractive index of this particular medium.

FIG. 1*c*, in particular, depicts a solution, wherein at least a locally periodic structure or a diffraction grating, functioning as an outcoupling system 2*u*, is arranged on the bottom surface of an indicator element 2 functioning as a waveguide. The diffraction grating divides an incident plane wave, having an angle of incidence $\gamma$, into a set of diffraction orders appearing both inside and outside the waveguide panel. The propagation directions thereof are determined by a grating equation and the diffraction efficiencies (that portion of incident light which ends up in a relevant order) are determined on the basis of the period and shape of a grating profile. The condition shown in FIG. 1*c* is such that outcoupling the waveguide appear a plurality of transmitted beams, the grating surface 2*u* being shown illuminated from a plurality of discrete directions. In practice, however, it shows illuminated over a wide angular range, since the waveguide contains a plurality of propagating plane waves which hit the surface in a continuum of various angles γ. An exact electromagnetic diffraction theory can also be used for designing surface profiles producing quite a large number of orders, having a desired distribution of diffraction efficiencies.

Thus, by an appropriate selection of surface profile parameters, it is possible to reach the very condition shown in FIG. 1*c*, wherein the reflected orders become dominated and the grating surface 2*u* is shown illuminated when viewed through the waveguide panel 2. This is a way of avoiding especially mechanical damage to the grating surface, although it can naturally be also protected with a certain type of protective layer as it is placed on the top surface of the indicator element 2. Moreover, according to the embodiment shown in FIG. 1*c*, it is desirable to provide a so-called diffuser 3 on the back surface of the indicator element 2 functioning as a waveguide panel for widening and equalizing the angular distribution of diffracted radiation, as well as for re-directing the beams set off in a wrong direction back to and through the panel.

Figure 2B:
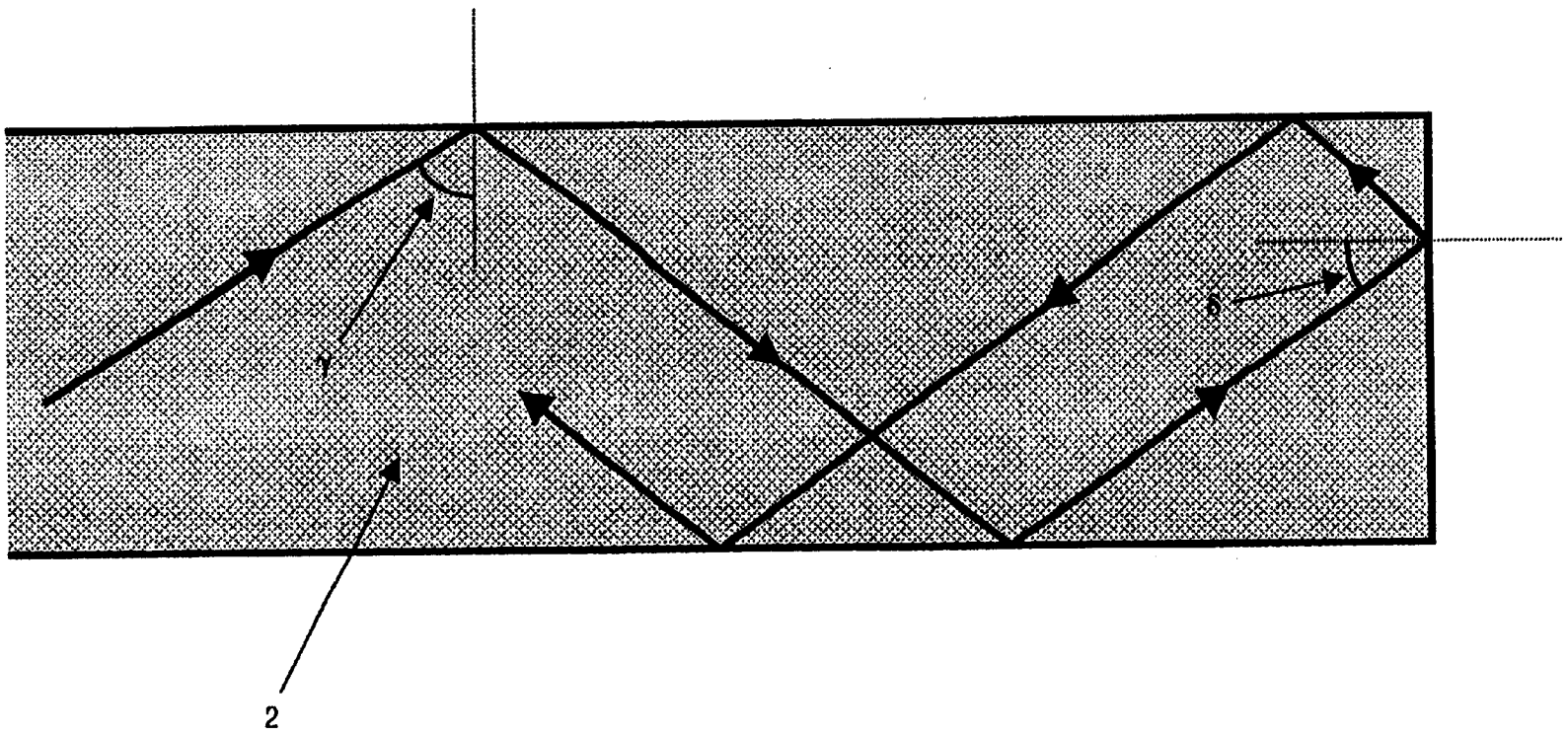
Figure 3:
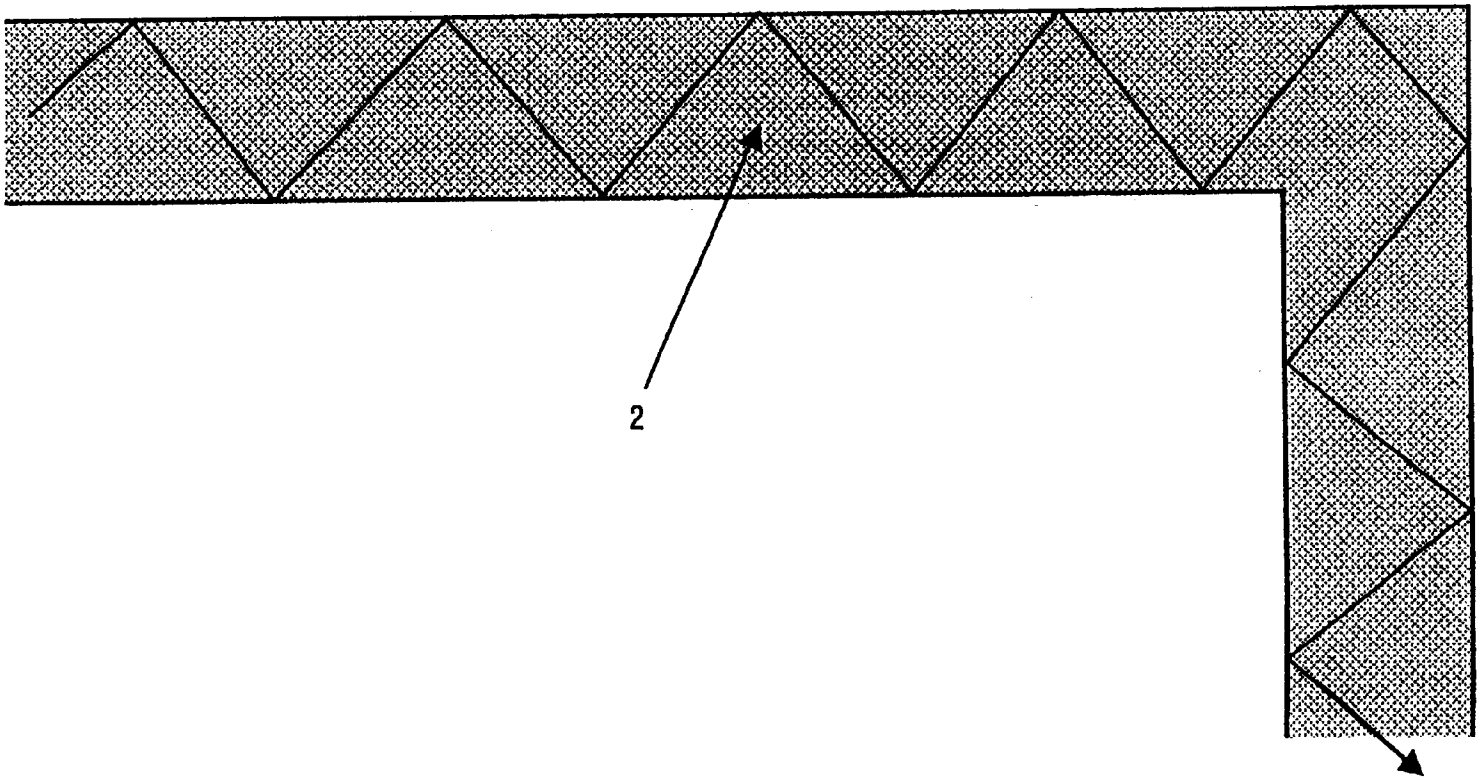

Another significant feature of the invention lies in the fact that light is kept by means of total reflection for as long as possible within the indicator element 2 functioning as a waveguide. This is possible when the light to be incoupled in a waveguide propagates within the same quite close to the threshold angle of total reflection, whereby its total reflection occurs, on the principle depicted in FIG. 2*b*, also from the end walls and propagates through the structure a number of times before diffracting by way of the outcoupling gratings 2*u*. In places with no outcoupling gratings, there is in principle no losses, either, whereby essentially all the light, which has been incoupled, emerges from desired illuminated areas with the exception of absorption taking place in the material. In a further reference to FIG. 3, it is hence possible, if necessary, to bend and/or form a waveguide panel as long as the local radius of curvature is everywhere so small that the limit or threshold angle of total reflection is not fallen short of. As depicted in the figure, it is obvious that a plane waveguide may include 90° angles without violating the principle of total reflection.

Figure 4:
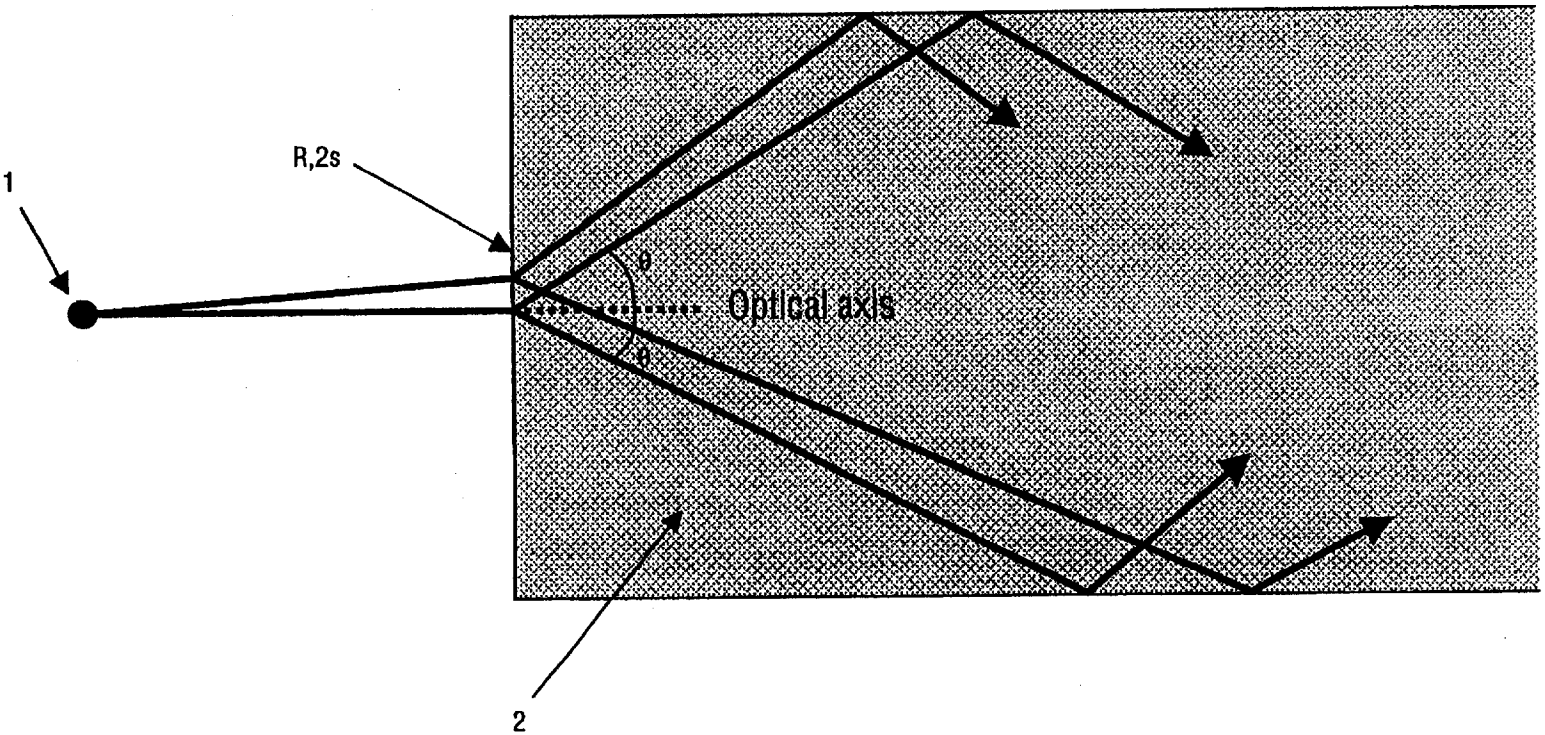
FIGS. 4, 5, 6*a*, and 6*b* illustrate certain general principles for an incoupling system associated with a light indicator of the invention.
Figure 5:
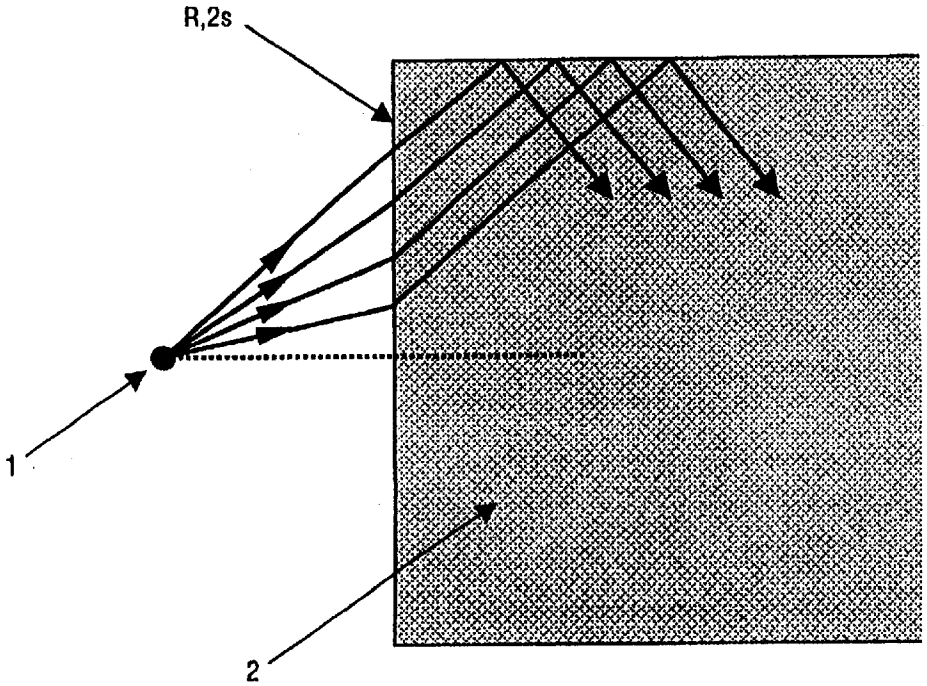

FIG. 4 further illustrates the way a diffractive element bent on a cylindrical surface operates in the plane of a beam propagating to an arbitrary angle θ. Since it is desirable to have all beams propagate with total reflection, it is most preferable to use in the proximity of an optical axis a binary beam distributor, having its period varying as a function of place. This is also a way of providing a manageable number of slightly divergent propagating beams. Further away from the optical axis, it is not possible to force both beams produced by the beam distributor (grating orders +1 and −1) to perform total reflection, and thus it preferable that a locally linear grating structure be used for a desired deviation, as shown in structure be used for a desired deviation, as shown in FIG. 5. Here, all beams are quasi-collimated to propagate in a common direction, such that the condition for total reflection is fulfilled for all of those. That requires the modulation of a local grating period at a diffractive incoupling surface as a function of place, and continuous surface profiles for achieving a high diffraction efficiency. The beam distributor means in the middle of an element can be created by a binary structure or the like.

Furthermore, in reference to the embodiment shown in FIG. 7, the light indicator is designed as a closed box-type structure or, in this case, as a tubular "light indicator post". Thus, it is preferred that the incoupling for a waveguide 2 be implemented by using e.g. beam distributor gratings 2*s* and by positioning a led/leds 1*a*' either inside or outside the tube. Thus, patterns to be mounted on a variety of columns can be illuminated in quite a simple and effective fashion.

It is obvious that the invention is not limited to the embodiments described and illustrated above, but it can be modified quite liberally within the scope of the basic concept of the invention. First of all, the filling factor of a diffractive outcoupling system, such as e.g. a local grating, can be used for contributing e.g. to a uniform light outcoupling as the diffraction efficiency is determined on the basis of a grating profile and shape, and to the angles of light outcoupling as the propagation directions and angles of light are determined by a grating equation. The optimal filling factor in each situation is calculable exactly with the aid of a computer. The diffractive outcoupling or incoupling system, such as diffractive structures or gratings, can be constituted by using not only divergent recesses and grooves of pixel structures but also binary pixels, whereby there is a distinctly perceivable ridge (top corner), a bottom, as well as a recess/groove, having its length modifiable from dot to infinity. Such structures can be continuous profiles/contours, which may vary liberally in terms of shape and size. Furthermore, the light source may be constituted not only by discrete light means but also by a solution fully integrated in a panel element functioning as a waveguide. It is naturally obvious that the material for an indicator element for use as a waveguide may comprise a most varying range of transparent materials, including glass. The waveguide system of the invention enables the manufacture of e.g. display panels with seven or more segments.

What is claimed is:

1. A light indicator, comprising, an indicator element operative to be illuminated by a light source, the indicator element comprising a substantially transparent material including an indicator pattern; and a diffractive outcoupling system arranged over at least a portion of a light surface of the indicator element and operative to outcouple light from the indicator element through the indicator pattern, the diffractive outcoupling system comprising a plurality of local grating elements, each of the plurality of local grating elements having a diffraction efficiency and comprising at least one pattern of at least one of grooves and recesses, the diffraction efficiency of the local grating elements varying over the outcoupling system as a function of location.

2. The light indicator according to claim 1, wherein the diffraction efficiency is varied by varying at least one of filling factor, shape, profile, size, and orientation of the at least one of grooves and recesses over the diffractive outcoupling system.

3. The light indicator according to claim 1, wherein the local grating elements comprise at least one of multi-shaped pixels, binary pixels, multi-shaped units and binary units.

4. The light indicator according to claim 1, further comprising:

a light source.

5. The light indicator according to claim 4, wherein the light source comprises at least one longitudinally successive LED.

6. The light indicator according to claim 5, further comprising:

a diffractive incoupling system operative to introduce light beams from the at least one longitudinally successive LED into the panel element, whereby the at least one longitudinally successive LED illuminates the indicator pattern of the indicator.

7. The light indicator according to claim 6, wherein the diffractive incoupling system is arranged at a boundary surface of the indicator element.

8. The light indicator according to claim 6, wherein the diffractive incoupling system comprises at least one of a binary beam distributor, a local grating structure, and a diffuser.

9. The light indicator according to claim 5, wherein light beams from the at least one longitudinally successive LED are introduced into the panel element by means of geometrical contours of a boundary surface of the indicator element.

10. The light indicator according to claim 4, wherein light beams from the light source are introduced into the panel element by means of geometrical contours of a boundary surface of the indicator element.

11. The light indicator according to claim 1, wherein the indicator element is designed as a waveguide panel.

12. The light indicator according to claim 1, wherein light beams propagate in the indicator element with total reflection.

13. The light indicator according to claim 1, wherein the diffractive outcoupling structure is configured as an indicator pattern.

14. The light indicator according to claim 13, wherein the diffractive outcoupling system is operative to produce an indicator pattern operative to be activated in the indicator element by light action.

15. The light indicator according to claim 1, further comprising:

a diffractive incoupling system operative to introduce light beams from the light source into the panel element.

16. The light indicator according to claim 15, wherein the diffractive incoupling system is arranged at a boundary surface of the indicator element.

17. The light indicator according to claim 15, wherein the diffractive incoupling system comprises at least one of a binary beam distributor, a local grating structure, and a diffuser.

18. The light indicator according to claim 1, wherein the diffractive outcoupling system is arranged on a bottom surface of the indicator element.

19. The light indicator according to claim 1, wherein the indicator element comprises a thin and optically clear manufacturing material having a thickness of 0.1–4 mm.

20. The light indicator according to claim 19, wherein the indicator element comprises a polymeric, elastomeric, or ceramic panel or sheet.

21. The light indicator according to claim 1, further comprising:

a diffractive incoupling system arranged at a perimeter of the indicator element and operative to introduce light beams from the light source into the indicator element.

22. The light indicator according to claim 1, wherein the indicator element comprises a flexible and/or preformed manufacturing material.

23. The light indicator according to claim 22, wherein the indicator pattern of the indicator element is adapted to activate by maintaining the indicator element everywhere at a local radius of curvature that is sufficiently small such that a threshold angle of total reflection is not exceeded as a light beam travels within the indicator element.

24. The light indicator according to claim 1, wherein the diffractive outcoupling system is operative with diffractive patterns of various colors.

25. The light indicator according to claim 24, further comprising:

at least one independently controlled lighting unit operative to produce light of various colors and operative produce to least one indicator image of the indicator pattern.

26. The light indicator according to claim 25, wherein the light of various colors is produced by varying at least one of an intensity and a supply voltage of the light source.

27. The light indicator according to claim 25, wherein the at least one independently controlled light unit comprises a red/green/blue/white LED.

28. The light indicator according to claim 1, wherein the indicator element comprises a responsive surface operative to eliminate beams transmitted from a grating structure of the outcoupling system and/or for preventing the formation of pronounced light spots.

29. The light indicator according to claim 28, wherein the responsive surface comprises at least one of a reflector and a diffuser.

30. The light indicator according to claim 1, further comprising:

a diffractive incoupling system comprising a beam distributor operative to introduce light beams from a light source into the indicator element, the indicator element being arranged at one of a front and a back surface of the indicator element and being operative to focus light received from a light source to propagate with total reflection within the indicator element, wherein the indicator element comprises a closed box.

* * * * *